US011499340B1

(12) United States Patent
Kim

(10) Patent No.: US 11,499,340 B1
(45) Date of Patent: Nov. 15, 2022

(54) KEY SYSTEM OF LOCK

(71) Applicant: Jung Kyu Kim, Daegu (KR)

(72) Inventor: Jung Kyu Kim, Daegu (KR)

( * ) Notice: Subject to any disclaimer, the term of this patent is extended or adjusted under 35 U.S.C. 154(b) by 0 days.

(21) Appl. No.: 17/885,818

(22) Filed: Aug. 11, 2022

(51) Int. Cl.

| | |
|---|---|
| ***E05B 27/00*** | (2006.01) |
| ***E05B 19/00*** | (2006.01) |
| ***E05B 27/10*** | (2006.01) |
| *E05B 27/02* | (2006.01) |

(52) U.S. Cl.
CPC ..... *E05B 27/0082* (2013.01); *E05B 19/0052* (2013.01); *E05B 19/0064* (2013.01); *E05B 27/0017* (2013.01); *E05B 27/0042* (2013.01); *E05B 27/0057* (2013.01); *E05B 27/10* (2021.08); *E05B 27/02* (2013.01)

(58) Field of Classification Search
CPC ..... E05B 19/0023; E05B 19/0052; E05B 19/0058; E05B 19/0064; E05B 27/0017; E05B 27/0035; E05B 27/0042; E05B 27/0057; E05B 27/0078; E05B 27/0082; E05B 27/02; E05B 27/08; E05B 27/086
See application file for complete search history.

(56) References Cited

U.S. PATENT DOCUMENTS

| | | | | |
|---|---|---|---|---|
| 4,393,673 A * | 7/1983 | Widen | E05B 27/0082 | 70/495 |
| 5,209,087 A * | 5/1993 | Cox | E05B 27/0082 | 70/369 |
| 5,715,717 A * | 2/1998 | Widen | E05B 27/0078 | 70/420 |
| 6,477,876 B1 | 11/2002 | Kim | | |
| 6,981,396 B1 * | 1/2006 | Kim | E05B 27/0082 | 70/369 |
| 8,056,379 B2 * | 11/2011 | Dickhans | E05B 27/0053 | 70/371 |
| 8,448,485 B1 * | 5/2013 | Widen | E05B 27/0017 | 70/494 |
| 9,127,480 B2 * | 9/2015 | Mathachan | E05B 27/0078 | |
| 10,273,717 B2 * | 4/2019 | Clifford | E05B 27/0007 | |
| 10,337,210 B2 * | 7/2019 | Widen | E05B 27/0007 | |
| 10,472,856 B1 * | 11/2019 | Widen | E05B 27/0057 | |
| 10,570,643 B2 * | 2/2020 | Widen | E05B 27/0007 | |
| 2014/0223977 A1 * | 8/2014 | Wu | E05B 27/0078 | 70/493 |

FOREIGN PATENT DOCUMENTS

| | | | | |
|---|---|---|---|---|
| CN | 1572998 A * | 2/2005 | E05B 19/0017 | |
| KR | 20160011185 | 1/2019 | | |

* cited by examiner

*Primary Examiner* — Christopher J Boswell
(74) *Attorney, Agent, or Firm* — IPLA P.A.

(57) ABSTRACT

A key system of a lock having a high peaking difficulty when picking is tried by a picking tool, includes three or more rectangular holes formed between pin holes of an inner case to insert rectangular pins, where each of the rectangular pin includes a side bar insertion groove and a fake groove formed to be spaced apart from the side bar insertion groove at an interval to raise the degree of picking difficulty. A quadrangular pin is inserted into the rectangular hole located in the middle among the rectangular holes formed in the inner case to be inserted into the hole formed in an outer case. The side on which the quadrangular pin is located has an escape groove to accommodate the quadrangular pin.

3 Claims, 9 Drawing Sheets

KEY SYSTEM OF LOCK

BACKGROUND

The present invention relates to a key system of a lock having a high difficulty in peaking, and more specifically, to a key system of a lock, which can raise the degree of difficulty when locking is released by a picking tool by improving a side bar and a rectangular pin among components for restricting or releasing an outer case and an inner case of the key system.

In general, a key system of a mechanical lock includes an outer case and an inner case, a plurality of locking pins and drive pins inserted into the outer and inner cases. When a key having an encrypted pattern is inserted into a key hole formed in the inner case and is rotated, positions of the locking pins are aligned according to the encrypted pattern of the key, so that restricted inner case and outer case of the key system are released. On the contrary, when the key gets out of the key hole, the inner case and the outer case are restricted by actions of the drive pin and a spring.

Such a conventional key system of the mechanical lock has a disadvantage in that a locked state is easily released by a picking tool. Therefore, recently, various structures of an improved key system of a mechanical lock have been disclosed. U.S. Pat. No. 6,477,876 B1 which was granted to the inventor of the present disclosure discloses a key system of a lock. The key system includes: locking pins and drive pins inserted into pin holes respectively formed in an outer case and an inner case to be operated by springs; rectangular grooves formed between the pin holes; rectangular pins respectively inserted into the rectangular grooves; and a side bar mounted between the outer case and the inner case and controlled in operation by the rectangular pins.

The rectangular pins of the key system are configured such that side bar insertion holes formed in the rectangular pins by an encrypted pattern formed on the side of a key are aligned so that the side bar mounted between the outer case and the inner case can release a locked state of the outer case and the inner case. Ordinarily, the side bar is pushed toward the side bar slot formed on the outer case by the spring so as to lock the inner case and the outer case. The rectangular pins are scattered by self-load so that the side bar insertion holes respectively formed in the rectangular pins get out of the side bar so as to prevent the side bar from being pushed toward the rectangular pins, thereby restricting the inner case and the outer case by the side bar.

As described above, the improved key system of the lock which can doubly restrict the inner case and the outer case by the locking pin and the side bar between the inner case and the outer case remarkably improved reliability of the lock. However, as picking tools and picking technique have developed, cases of being picked frequently occur, and so, it lowers confidence in the mechanical lock due to the disappointing result. Therefore, a key system of a mechanical lock which is not picked even by advanced picking tools and technique is required urgently.

Cited References: U.S. Pat. No. 6,477,876 B1 (Granted on Nov. 12, 2002) and Korean Patent No. 10-1915838 (Granted on Oct. 31, 2018).

SUMMARY OF THE INVENTION

Accordingly, the present invention has been made in view of the above-mentioned problems occurring in the prior art, and it is an object of the present invention to provide a key system of a lock, which can restrict (lock) or release an outer case and an inner case at three points to perfectly keep a locked state, thereby raising the degree of difficulty in picking tried by a picking tool.

In particular, it is another object of the present invention to provide a key system of a lock, which includes improved rectangular pins for controlling a side bar and movement of the side bar mounted between the inner case and the outer case, and a quadrangular pin, thereby raising the degree of difficulty in picking tried even by advanced picking tool and technique for releasing a locked state of the key system.

To accomplish the above object, according to the present invention, there is provided a key system of a lock having a high peaking difficulty, including: an inner case and an outer case which are coupled to each other to be rotatable; locking pins and drive pins which are respectively inserted into pin holes formed in the outer case and the inner case to be operated by springs; three or more rectangular holes formed between the pin holes formed in the inner case so that rectangular pins are respectively inserted into the rectangular holes; and a side bar mounted between the inner case and the outer case to be controlled in operation by the rectangular pins, wherein a portion of the side bar goes in and out of a side bar slot formed in the outer case.

Each of the rectangular pins has the side bar insertion groove and a fake groove spaced apart from the side bar insertion groove to raise the degree of picking difficulty. A quadrangular pin is inserted into the rectangular hole located in the middle among the rectangular holes formed in the inner case to go in and out of a hole formed in the outer case. The side bar on which the quadrangular pin is located has an escape groove for accommodating the quadrangular pin.

When a key having an encrypted pattern is inserted into a key hole formed in the inner case, the locking pins, the rectangular pins, and the quadrangular pin are aligned. Thereafter, when the key is rotated, the inner case is also rotated so as to release a locked state of the lock.

The key system of a lock according to the present invention can perfectly maintain the locked state of the key system and remarkably improve the degree of difficulty in picking.

Particularly, the key system of a lock according to the present invention includes the fake grooves which are formed in the rectangular pins to confuse the fake grooves with side bar insertion grooves when someone tries to pick the lock using a picking tool, and the quadrangular pin configured to prevent unlocking by the picking tool, thereby raising the degree of difficulty in picking.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

Figure 1:
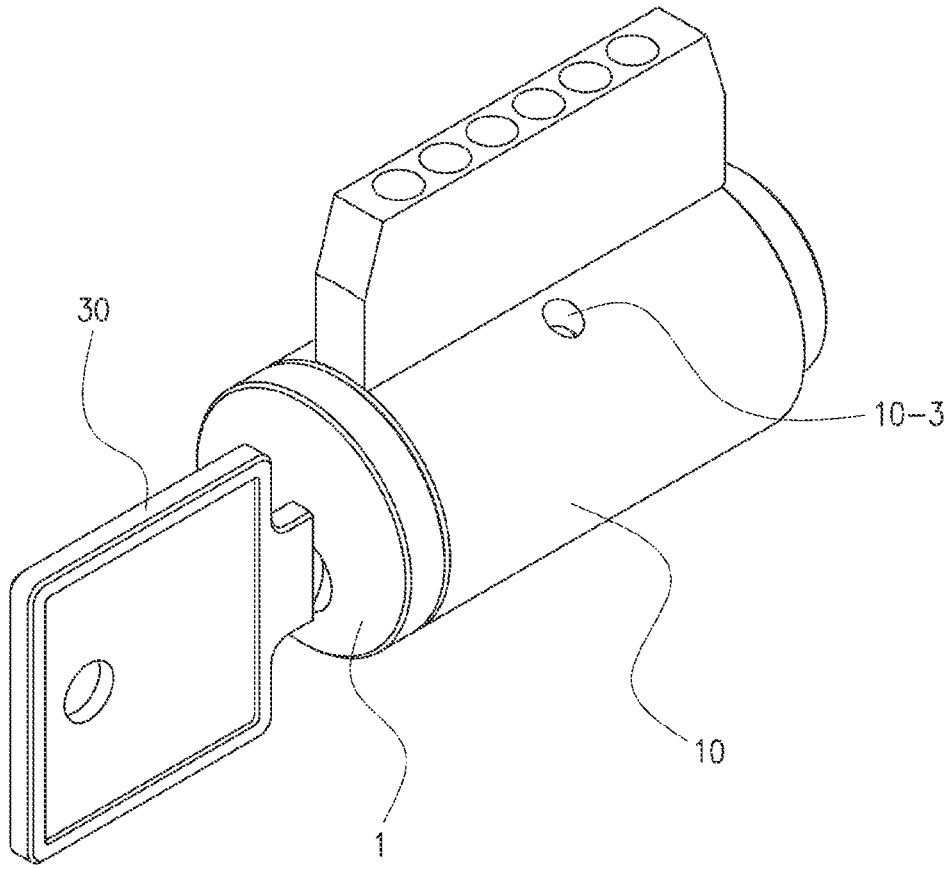
FIG. 1 is a perspective view illustrating a key system of a lock according to an embodiment of the present invention.
Figure 2:
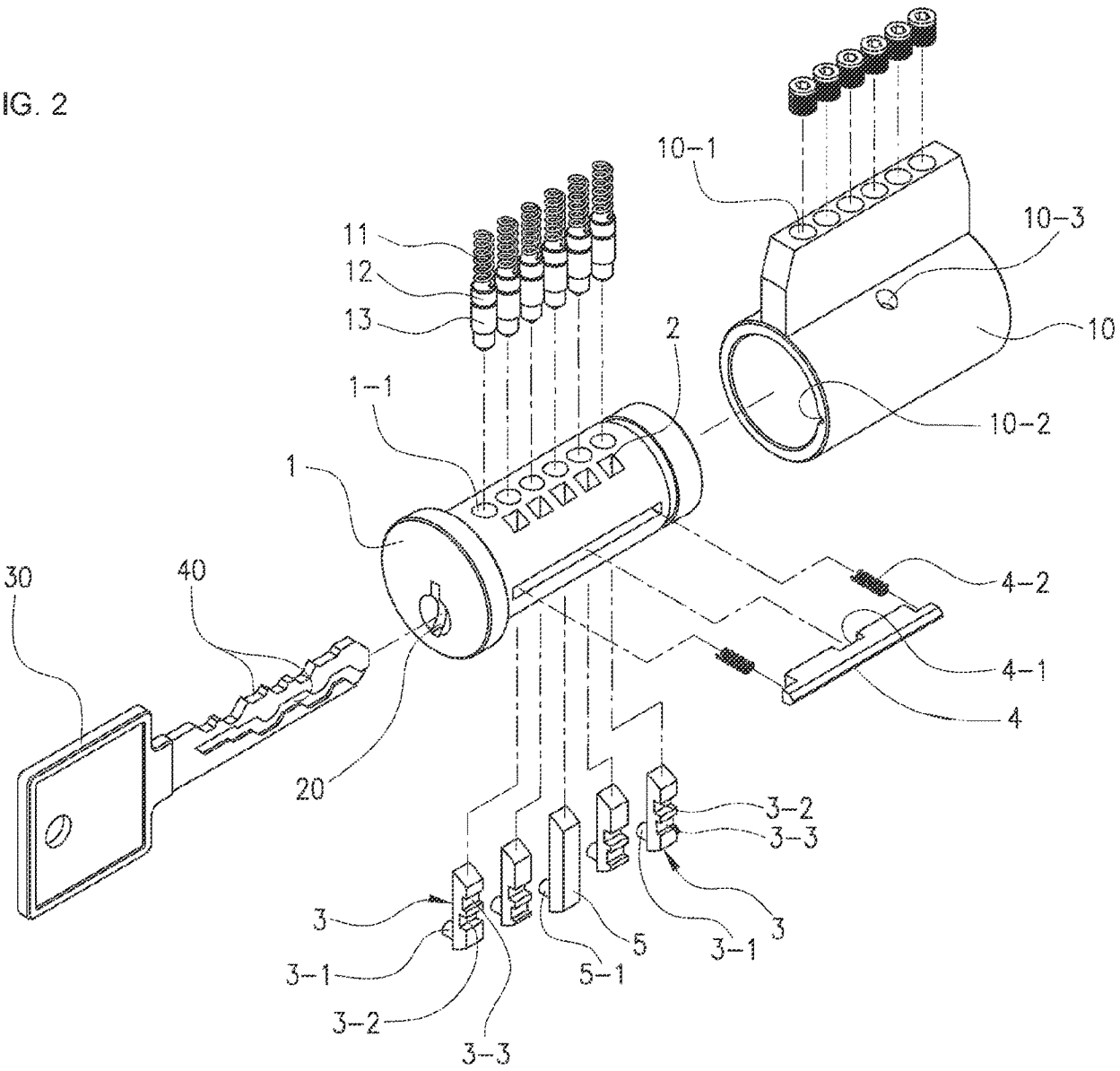
FIG. 2 is an exploded perspective view illustrating the key system of a lock according to the embodiment of the present invention.
Figure 3:
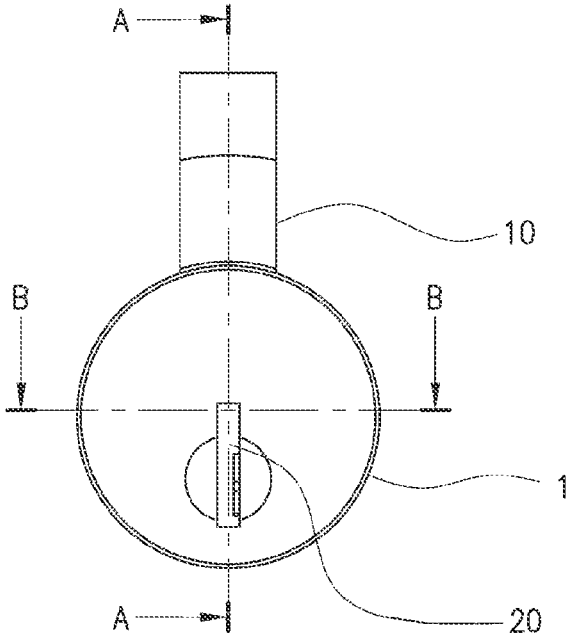
FIG. 3 is a front view illustrating the key system of a lock according to the embodiment of the present invention.
Figure 4:
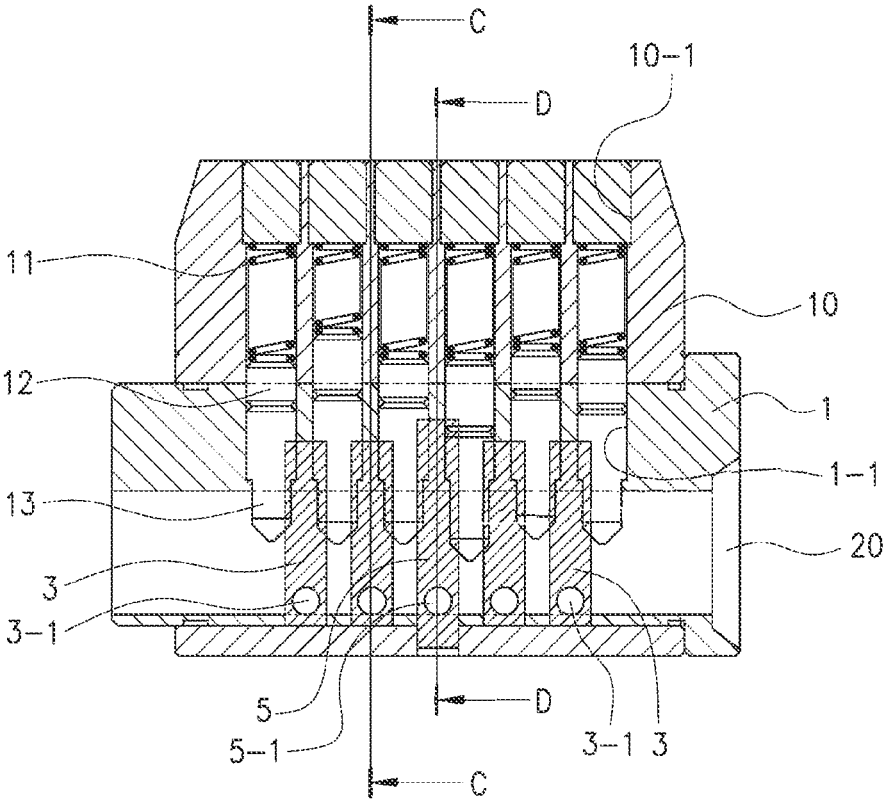
FIG. 4 is a cross-sectional view taken along the line A-A of FIG. 3.
Figure 5:
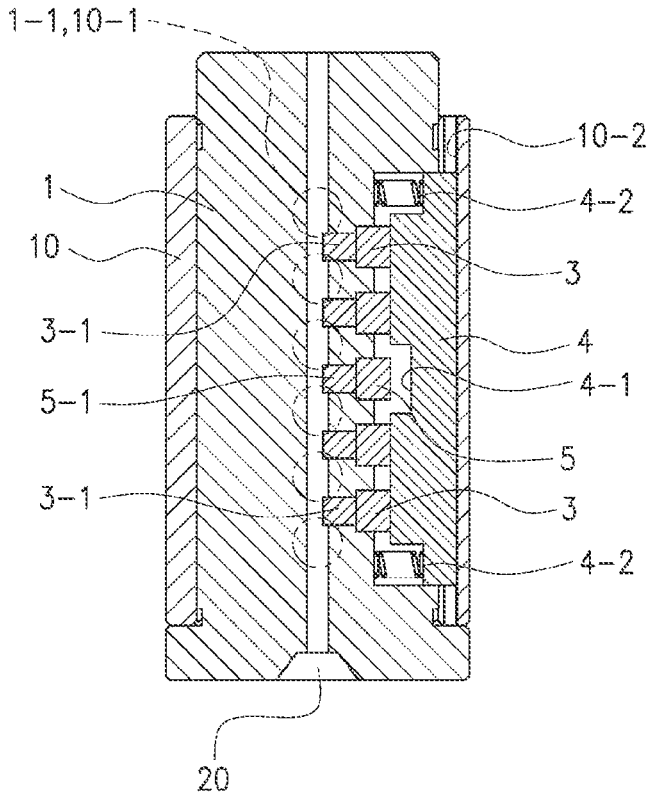
FIG. 5 is a cross-sectional view taken along the line B-B of FIG. 3.
Figure 6:
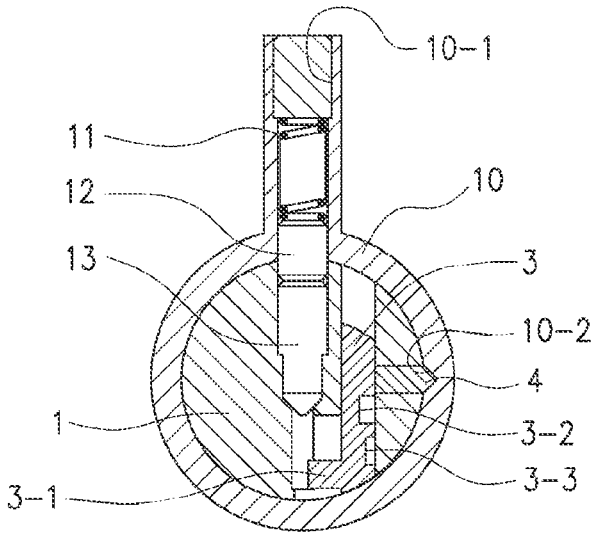
FIG. 6 is a cross-sectional view taken along the line C-C of FIG. 4.
Figure 7:
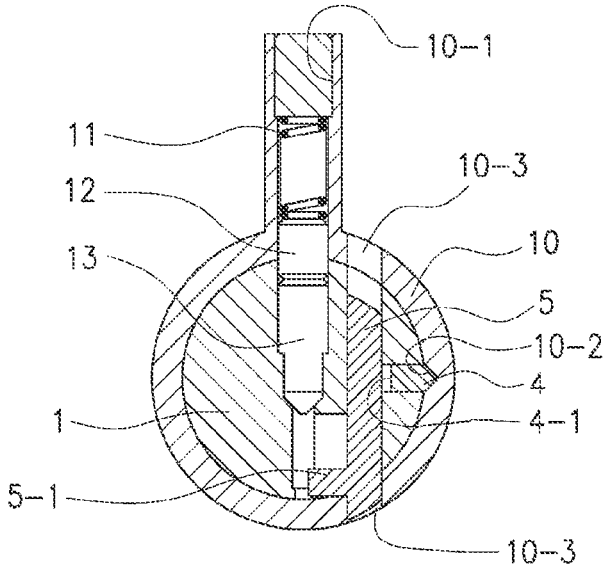
FIG. 7 is a cross-sectional view taken along the line C-C of FIG. 4.
Figure 8:
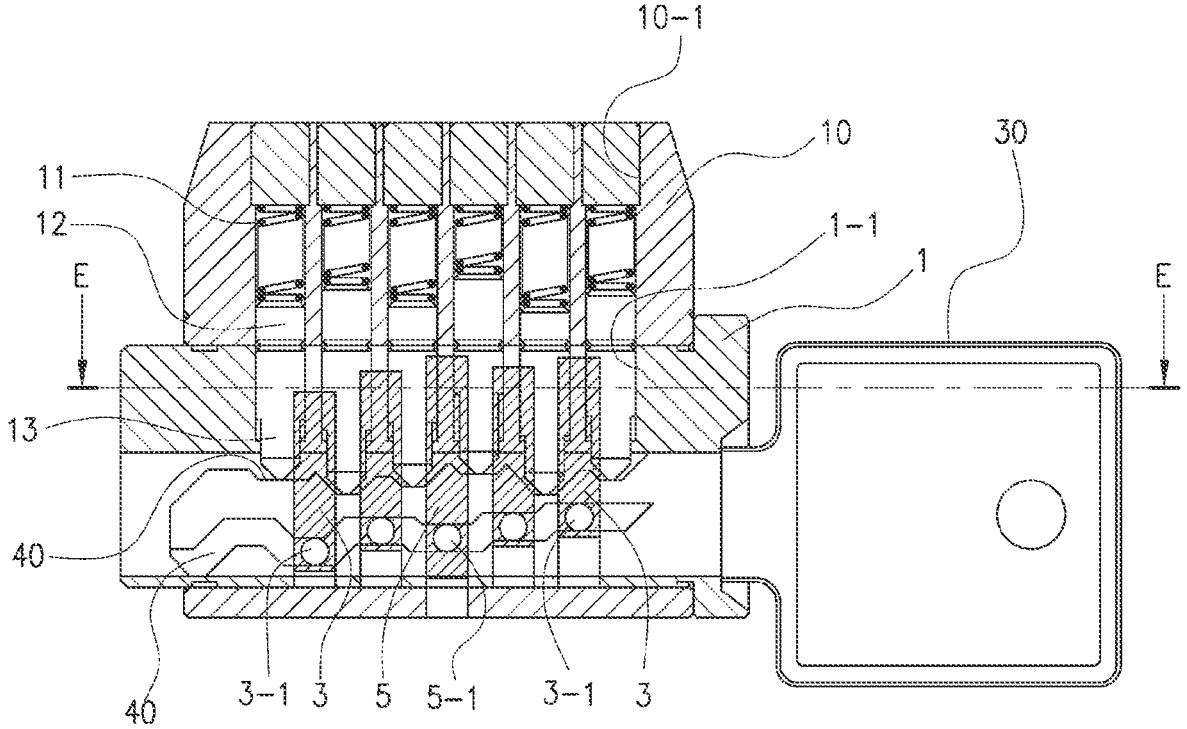
FIG. 8 is a diagram illustrating a state in which a key is combined with the key system of the lock.
Figure 9:
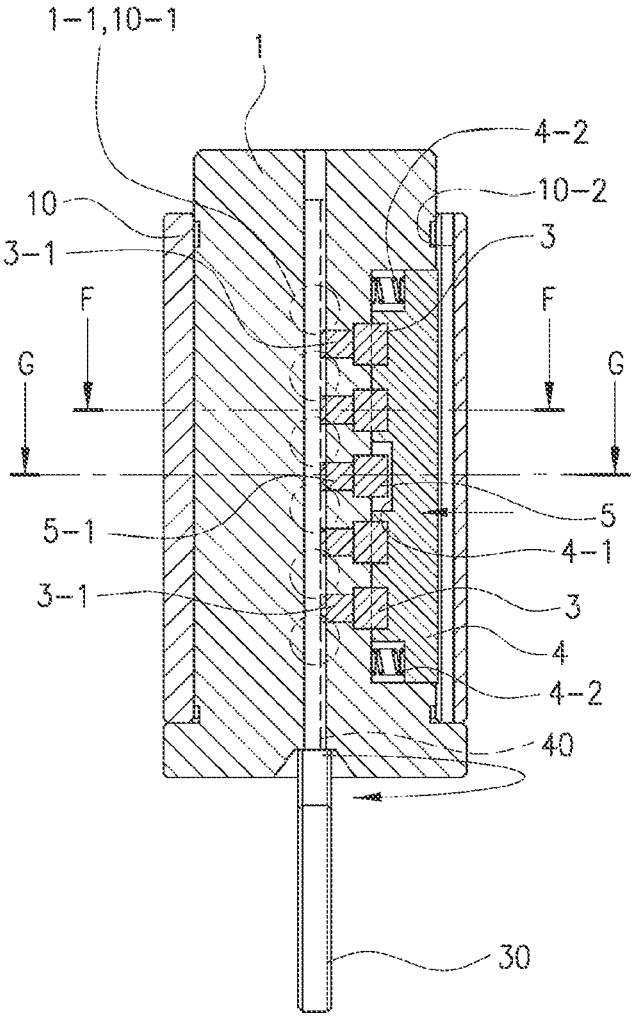
FIG. 9 is a cross-sectional view taken along the line E-E of FIG. 8.
Figure 10:
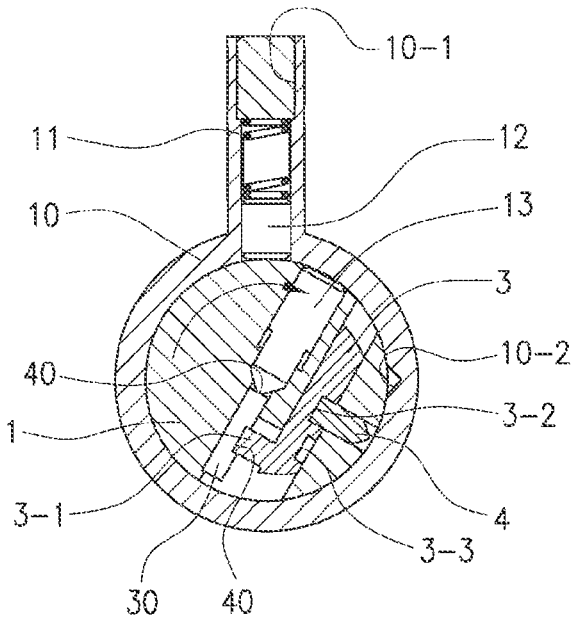
FIG. 10 is a cross-sectional view taken along the line F-F, showing a state in which rectangular pins and a side bar release a locked state.
Figure 11:
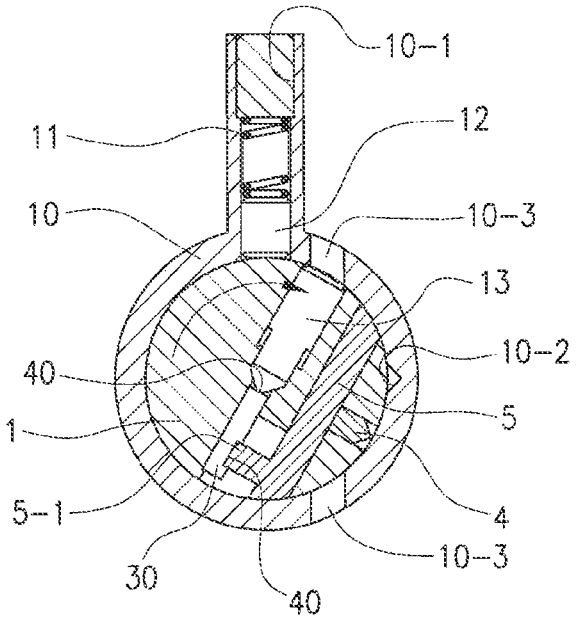
FIG. 11 is a cross-sectional view taken along the line F-F, showing a state in which a quadrangular pin and the side bar release a locked state.

Hereinafter, a key system of a lock having a high peaking difficulty according to a preferred embodiment of the present invention will be described in detail with reference to the accompanying drawings.

The key system of a lock having a high peaking difficulty according to the present invention includes: an outer case 10; an inner case 1 disposed inside the outer case to be rotatable; three or more pin holes 10-1 and 1-1 formed in the outer case 10 and the inner case 1 on the same line; locking pins 12 and drive pins 13 inserted into the pin holes to be operated by springs.

The key system of a lock according to the present invention further includes: three or more rectangular holes formed between the pin holes 1-1 of the inner case 1; rectangular pins 3 which are respectively inserted into the rectangular holes 2 and each of which has a side bar insertion groove 3-2 and a retaining protrusion 3-1 formed in the opposite direction to the side bar slot; a side bar 4 mounted between the outer case 10 and the inner case 1 together with springs 4-2 to be controlled in operation by the rectangular pins; and a side bar slot 10-2 formed in the outer case 10 so that one side of the side bar 4 goes in and out.

Each of the rectangular pin 3 includes: a fake groove 3-3 formed at an interval from the side bar insertion groove 3-2 so as to raise the degree of picking difficulty when being picked. A quadrangular pin 5 having a retaining protrusion 5-1 is inserted into the rectangular hole located in the middle among the three or more rectangular holes formed in the inner case. The outer case 10 has holes 10-3 formed in the top and the bottom thereof so that a portion of the quadrangular pin 5 goes in and out. The side bar 4 on which the quadrangular pin 5 is located has an escape groove 4-1 formed to accommodate the quadrangular pin 5.

When a key 30 having an encrypted pattern is inserted into a key hole 20 formed in the inner case 1, the locking pins 12, the rectangular pins 3, and the quadrangular pin 5 are aligned. Thereafter, when the key is rotated, the inner case 1 is also rotated so as to release a locked state of the lock.

In the drawings, the reference numeral 40 designates an encrypted pattern formed on the key 30.

Now, the operation of the key system of the lock having a high peaking difficulty according to the present invention will be described in detail.

The locking pins 12 inserted into the pin holes 10-1 and 1-1 formed in the outer case 10 and the inner case 1 are located between the outer case and the inner case by the action of the drive pins 13 and the springs 11. Then, the side bar 4 is pushed out by the springs 4-2 so as to be coupled to the side bar slot 10-2 formed in the outer case 10. The quadrangular pin 5 is coupled to any one among the holes 10-3 formed at the top and the bottom of the outer case 10 so as to keep a perfectly locked state.

In the locked state of the key system, when the key 30 having the encrypted pattern is inserted into the key hole 20 formed in the inner case, the locking pins 12, the rectangular pins 3, and the quadrangular pin 5 are aligned to release a restricted state of the inner case and the outer case. In the above state, when the key is rotated, the inner case 1 is also rotated together with the key so as to release the locked state. By the above operation, the locked state of the key system of the lock according to the present invention is released by a normal key having an encrypted pattern.

That is, the locked state of the key system of the lock according to the present invention can be released by the normal key having an encrypted pattern, but it is difficult or impossible to release the locked state when picking is tried by using a picking tool. The operation will be described as follows.

Description of a process that the drive pins 13 and the locking pins 12 inserted into the pin holes 10-1 and 1-1 of the outer case 10 and the inner case 1 are picked by the picking tool will be omitted since it is not the operation that the present invention pursues. A process that someone tries to perform picking to the side bar, the rectangular pins and the quadrangular pin, which are the core of the present invention, will be described.

First, a picking tool (not shown) touches the retaining protrusion 3-1 formed on the rectangular pin 3 disposed at the innermost portion of the inner case 1 to match the location of the side bar insertion groove 3-2 with the location of the side bar 4. Next, the picking tool touches the retaining protrusion 3-1 of the rectangular pin 3 located next to the above-mentioned rectangular pin 3 to match the location of the side bar insertion groove 3-2 with the location of the side bar 4. After that, the picking tool touches the retaining protrusion 5-1 formed on the quadrangular pin 5 to perform picking.

However, since the quadrangular pin 5 does not have the side bar insertion groove 3-2 and the fake groove 3-3 formed in the rectangular pin 3 and the escape groove 4-1 of the side bar is located on the quadrangular pin 5, the quadrangular pin 5 is free without being restricted. Accordingly, since the quadrangular pin 5 is always inserted into any one among the holes 10-3 formed at the top and the bottom of the outer case 10, it is difficult or impossible to perform picking.

Accordingly, the person who tries picking skips the quadrangular pin 5 and picks the rectangular pin located at the front. However, as time goes by, the rectangular pin which is located at the innermost portion and the rectangular pin which is located next to the innermost pin cannot keep the picked state after being picked. Finally, the key system of the lock according to the present invention can prevent picking to release the locked state.

Meanwhile, while picking is tried, the fake groove 3-3 spaced apart from the encrypted side bar insertion groove 3-2 at an interval is located on the side bar 4. Moreover, since the quadrangular pin 5 moves freely unless using the key having the encrypted pattern, the quadrangular pin 5 is always inserted into any one among the holes 10-3 formed at the top and the bottom of the outer case 10, and it makes picking difficult or impossible. Therefore, the key system of the lock according to the present invention can more perfectly prevent the locked state from being released by a picking tool.

What is claimed is:

1. A key system of a lock having a high peaking difficulty, which includes an outer case and an inner case having three or more pin holes formed in the outer case and the inner case on the same line, and springs, locking pins, and drive pins inserted into the pin holes, comprising:

three or more rectangular holes formed between the pin holes of the inner case;

rectangular pins which are respectively inserted into the rectangular holes, and each of which has a side bar insertion groove and a retaining protrusion formed in the opposite direction to the side bar slot;

a side bar mounted between the outer case and the inner case together with springs to be controlled in operation by the rectangular pins, a portion of the side bar going in and out of a side bar slog formed in the outer case; and a quadrangular pin having a retaining protrusion, and inserted into any one among the three or more rectangular holes of the inner case so that a portion of the quadrangular pin is inserted into holes formed in the outer case, wherein the side bar on which the quadrangular pin is located has an escape groove to accommodate the quadrangular pin.

2. The key system of a lock according to claim 1, wherein a fake groove is formed to be spaced apart from the side bar insertion groove at an interval so as to raise the degree of picking difficulty when picking is tried.

3. The key system of a lock according to claim 1, wherein the quadrangular pin is inserted into the rectangular holes except the first and final rectangular holes among the three or more rectangular holes formed in the inner case, and the escape groove of the side bar for accommodating the quadrangular pin is formed to correspond to the quadrangular pin.

* * * * *